US007305716B1

(12) United States Patent
Richards

(10) Patent No.: US 7,305,716 B1
(45) Date of Patent: Dec. 11, 2007

(54) SEPARABLE HOSPITAL GOWN

(76) Inventor: Harlan J. Richards, 190 E. Olmstead Dr., #A-12, Titusville, FL (US) 32780

( * ) Notice: Subject to any disclaimer, the term of this patent is extended or adjusted under 35 U.S.C. 154(b) by 0 days.

(21) Appl. No.: 11/213,452

(22) Filed: Aug. 26, 2005

Related U.S. Application Data

(60) Provisional application No. 60/605,087, filed on Aug. 27, 2004.

(51) Int. Cl.
*A41B 9/00* (2006.01)
*A41B 1/08* (2006.01)

(52) U.S. Cl. ..... 2/114; 2/121

(58) Field of Classification Search ..... 2/121, 2/114, 83, 104, 75, 80, 111, 244
See application file for complete search history.

(56) References Cited

U.S. PATENT DOCUMENTS 1,766,272 A * 6/1930 Vallier ..... 2/114
2,051,444 A * 8/1936 Haister ..... 2/76
2,319,089 A * 5/1943 Severance ..... 2/114
2,528,340 A * 10/1950 Coven ..... 2/114
2,589,916 A * 3/1952 Wyner ..... 2/11
2,701,364 A * 2/1955 Palm ..... 2/114
2,707,282 A * 5/1955 Paterson ..... 2/114
2,768,383 A * 10/1956 De Witt ..... 2/114
3,129,432 A * 4/1964 Belkin ..... 2/114
3,259,913 A * 7/1966 Tames ..... 2/114
3,344,435 A * 10/1967 Artzt ..... 2/111
3,464,063 A * 9/1969 Hoegerman ..... 2/114
3,638,334 A * 2/1972 Malikowski ..... 434/260
3,696,443 A * 10/1972 Taylor ..... 2/114
3,803,640 A * 4/1974 Ericson ..... 2/114
3,824,625 A * 7/1974 Green ..... 2/114
4,215,434 A * 8/1980 Barron ..... 2/114
4,434,511 A * 3/1984 Weiser ..... 2/114
4,524,463 A * 6/1985 Ogden ..... 2/105
4,570,268 A * 2/1986 Freeman ..... 2/114
4,578,825 A * 4/1986 Vote ..... 2/114
4,590,624 A * 5/1986 Weiser ..... 2/114
4,653,120 A * 3/1987 Leaf ..... 2/114
4,683,594 A * 8/1987 Feinberg ..... 2/105
4,718,124 A * 1/1988 Sawicki et al. ..... 2/114
4,745,634 A * 5/1988 Douez ..... 2/69
4,787,101 A * 11/1988 Feinberg ..... 2/105
4,864,657 A * 9/1989 Lake ..... 2/114
4,920,578 A * 5/1990 Janzen et al. ..... 2/114
4,969,215 A * 11/1990 Burkett ..... 2/114
4,972,832 A * 11/1990 Trapini et al. ..... 607/108
4,975,984 A * 12/1990 Sting ..... 2/114
5,050,243 A * 9/1991 Udell ..... 2/114
5,062,159 A * 11/1991 Jakub ..... 2/114
5,083,315 A * 1/1992 Dillon, Jr. ..... 2/51

(Continued)

*Primary Examiner*—Alissa Hoey
*Assistant Examiner*—Jena A Sold
(74) *Attorney, Agent, or Firm*—Kenneth L Tolar

(57) ABSTRACT

A medical gown includes separable portions that can be joined using color coded fasteners. The garment includes a pair of sleeve portions each having a separable seam extending from a neck opening to a distal end of the sleeve portion. Disposed along each of two opposing edges of the separable seam are a plurality of mating, color-coded fasteners allowing a medical worker to easily secure the garment about a patient. The garment also includes a back flap that wraps around to partially overlay a front surface of the garment, and which is likewise secured with color-coded fasteners.

4 Claims, 1 Drawing Sheet

U.S. PATENT DOCUMENTS 5,088,117 A * 2/1992 Fulmer ..... 2/114
5,097,536 A * 3/1992 Cohen ..... 2/114
5,150,477 A * 9/1992 Elberson et al. ..... 2/114
5,184,351 A * 2/1993 Benstock ..... 2/114
5,361,414 A * 11/1994 Smith ..... 2/114
5,425,702 A * 6/1995 Carn et al. ..... 602/62
5,444,872 A * 8/1995 Johnson ..... 2/114
5,553,323 A * 9/1996 Chou et al. ..... 2/114
D374,970 S * 10/1996 Jagger ..... D2/720
5,609,569 A * 3/1997 Offenhartz ..... 602/61
5,661,852 A * 9/1997 Kessler ..... 2/114
5,799,328 A * 9/1998 Harlem et al. ..... 2/69
5,806,096 A * 9/1998 Pennington ..... 2/80
5,975,558 A * 11/1999 Sittu ..... 280/647
5,991,923 A * 11/1999 Maria ..... 2/83
6,006,358 A * 12/1999 Keating ..... 2/161.1
6,134,715 A * 10/2000 McLennan ..... 2/114
6,151,715 A * 11/2000 Doherty ..... 2/48
6,216,271 B1 * 4/2001 Chen ..... 2/69
D457,289 S * 5/2002 Shorr ..... D2/720
6,460,187 B1 * 10/2002 Siegel ..... 2/114
6,477,710 B1 * 11/2002 Ojoyeyi ..... 2/69
6,564,386 B2 * 5/2003 Fujikawa et al. ..... 2/51
6,574,800 B1 * 6/2003 Leger et al. ..... 2/114
2005/0132465 A1 * 6/2005 Kathumbi-Jackson et al. . 2/114
2006/0277655 A1 * 12/2006 Kerr ..... 2/114

* cited by examiner

SEPARABLE HOSPITAL GOWN

CROSS REFERENCE TO RELATED APPLICATIONS

This application is entitled to the benefit of provisional application No. 60/605,087 filed on Aug. 27, 2004.

BACKGROUND OF THE INVENTION

The present invention relates to a medical gown having separable portions that are secured with color-coded snaps for quickly and easily securing the gown about a patient.

DESCRIPTION OF THE PRIOR ART

Conventional hospital gowns and other similar medical garments include separable seams that are joined with buttons or snaps allowing the garment to be easily placed onto a patient without disturbing surgical sites, intravenous insertion points and other vulnerable locations. However, properly mating the numerous buttons or snaps is always difficult. Often, snaps or buttons are fastened and separated several times until an appropriate match is obtained. The present invention addresses this problem by providing a uniquely designed medical gown having separable seams that are joined with color coded snaps allowing medical personnel to quickly and conveniently secure the garment about a patient.

SUMMARY OF THE INVENTION

The present invention relates to a separable medical gown. The device comprises an elongated gown member having a torso section, a pair of sleeve sections and a neck opening at an upper end. Each sleeve section includes an elongated separable seam extending from the neck opening to a distal end of the sleeve. The seam is separable and re-attachable using a series of color-coded snaps. For example, a first male snap on one side of the seam is discretely colored identically to the matching female snap on the opposing side of the seam. Accordingly, a user can easily match the mating snaps according to color. The torso section is also separable and includes a larger back flap that extends around a smaller back flap and partially overlays a front surface of the torso section. The larger back flap includes numerous color-coded snaps for further securing the garment to the wearer.

It is therefore an object of the present invention to provide a separable medical gown having color-coded fasteners for quickly and easily securing the gown about a patient.

It is another object of the present invention to provide a separable medical gown that eliminates the burden associated with securing conventional medical garments.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 2:
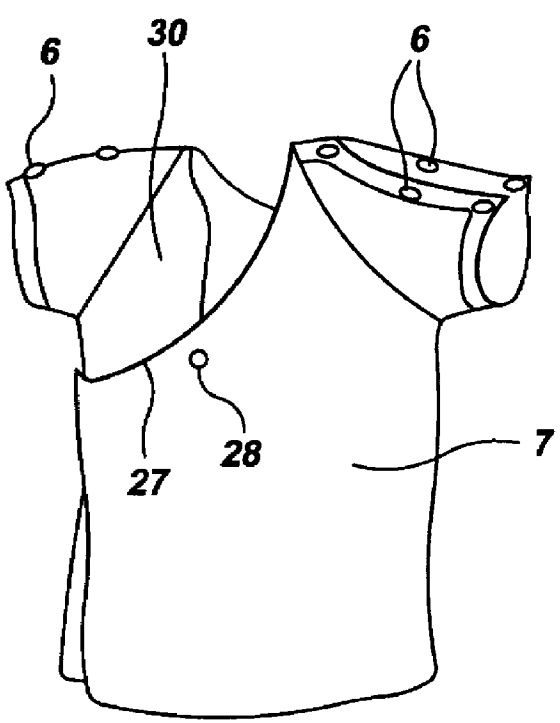
FIG. 2 is a rear, plan view of the gown.
Figure 1:
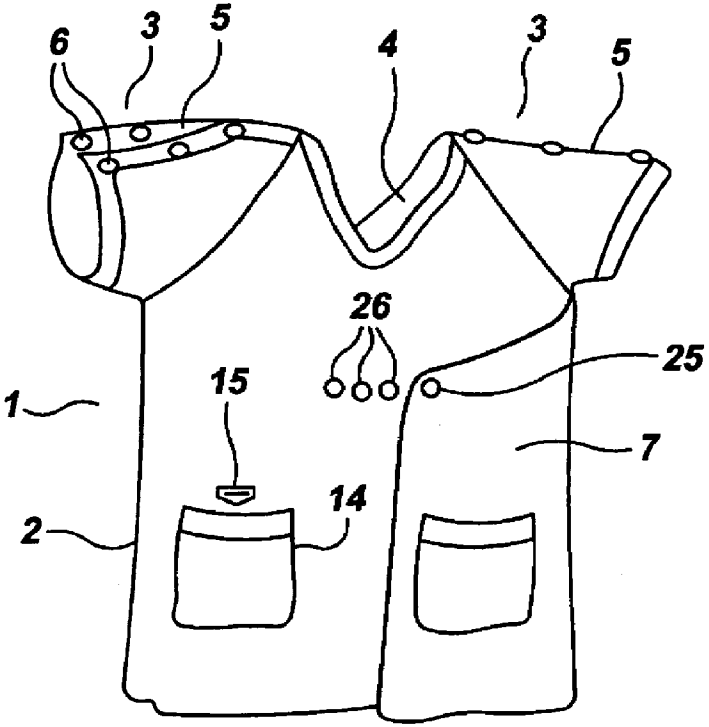
FIG. 1 is a front, plan view of the gown.

The present invention relates to a medical gown. The device comprises an elongated gown member 1 having a torso section 2, a pair of sleeve sections 3 and a neck opening 4 at an upper end. Each sleeve section includes an elongated separable seam 5 extending from the neck opening to a distal end of the sleeve. The seam is separable and re-attachable using a series of color-coded snaps 6. A first male snap on one side of the seam has a discrete color that is identical to that of the matching female snap on the opposing side of the seam. For example, the first set of snaps may be red, a second set, blue, a third, green, etc. Accordingly, a user can easily join the mating snaps according to color thereby eliminating the "trial and error" that is often incurred with conventional garments.

The torso section includes a front surface and a separable rear surface formed of a smaller back flap 30 and an overlapping larger back flap 7 that extends around the wearer's side to partially overlay the front surface of the torso section. A snap 25 is adjacent a side edge of the larger flap, which is color-coded to correspond with any one of three mating snaps 26 on the front surface of the torso section allowing the size of the secured garment to be varied. The larger flap further includes a downwardly contoured upper edge 27 with a snap 28 adjacent thereto that mates with a similarly colored snap on the smaller flap.

A pocket 14 is positioned on the front surface of the torso section for storing accessories. Immediately above the pocket is a small opening 15 for allowing heart monitor wires and similar medical related equipment to pass through the garment.

The above described device is not limited to the exact details of construction and enumeration of parts provided herein. Furthermore, the size, shape and materials of construction can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A medical gown comprising:

a gown member having a torso section, a pair of sleeve sections and a neck opening at an upper end, each of said sleeve sections including an elongated separable seam extending from the neck opening to a distal end of the sleeve, each seam including a first side and a second side, said torso section including a front surface and a separable rear surface, said rear surface having a smaller flap and an overlapping larger flap that extends around a wearer's side to partially overlay the front surface of the torso section, said larger flap having a color-coded snap fastener thereon that selectively engages any one of a plurality of mating color-coded snap fasteners on the front surface of the torso section allowing the size of the garment to be varied, and said larger flap further including a downwardly contoured upper edge with a color-coded snap fastener adjacent thereto that mates with a similarly colored snap on the smaller flap;

a plurality of color-coded fasteners adjacent the first side and the second side of each seam allowing said fasteners to be quickly and easily matched with a mating fastener according to color, wherein said fasteners are snaps including a first male snap on the first side of the seam and a second mating female snap on the second side of the seam, said male snap having a discrete color, said female snap having a discrete color that is identical to that of said male snap allowing a user to quickly and accurately mate said fasteners.

2. The medical gown according to claim 1 further comprising a pocket positioned on the torso section for storing accessories.

3. The medical gown according to claim 2 further comprising a small opening adjacent said pocket that allows medical equipment to pass through said garment.

4. The medical gown according to claim 2 further comprising a second pocket on a front edge of said larger flap that is positioned on a wearer's front torso when said larger flap is extended around a wearer's side to partially overlay the front surface of the torso section.

* * * * *